US008633427B2

(12) United States Patent
Yilmaz et al.

(10) Patent No.: US 8,633,427 B2
(45) Date of Patent: Jan. 21, 2014

(54) HIGH-FREQUENCY HEATING DEVICE

(75) Inventors: Namik Yilmaz, Istanbul (TR); Cem Kural, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 2155 days.

(21) Appl. No.: 10/597,338

(22) PCT Filed: Jan. 27, 2005

(86) PCT No.: PCT/IB2005/050363

§ 371 (c)(1),
(2), (4) Date: Jul. 20, 2006

(87) PCT Pub. No.: WO2005/074323

PCT Pub. Date: Aug. 11, 2005

(65) Prior Publication Data

US 2008/0257881 A1 Oct. 23, 2008

(30) Foreign Application Priority Data

Jan. 28, 2004 (TR) ..... a 2004/00154

(51) Int. Cl.
*H05B 6/68* (2006.01)

(52) U.S. Cl.
USPC ..... 219/702; 219/715

(58) Field of Classification Search
USPC ..... 219/702, 703, 679–680, 715, 716, 718
See application file for complete search history.

(56) References Cited

U.S. PATENT DOCUMENTS

| | | | | |
|---|---|---|---|---|
| 4,724,291 | A * | 2/1988 | Inumada | 219/718 |
| 4,956,581 | A | 9/1990 | Nilssen | |
| 5,091,617 | A | 2/1992 | Maehara et al. | |
| 5,300,744 | A | 4/1994 | Maehara et al. | |
| 2003/0117077 | A1 | 6/2003 | Jang et al. | |

FOREIGN PATENT DOCUMENTS

| | | |
|---|---|---|
| EP | 0279514 A | 8/1988 |
| EP | 0493604 A | 7/1992 |
| EP | 1324637 A | 7/2003 |

* cited by examiner

*Primary Examiner* — Quang Van
(74) *Attorney, Agent, or Firm* — Venable, Campillo, Logan & Meaney PC

(57) ABSTRACT

The high-frequency heating device, the subject of the present invention, is driven by an inverter and, by reducing the power losses in the mentioned inverter the operating efficiency is increased.

2 Claims, 2 Drawing Sheets

HIGH-FREQUENCY HEATING DEVICE

FIELD OF THE INVENTION

This invention relates to a high-frequency heating device with an increased operating efficiency wherein a magnetron driven by an inverter is utilized.

BACKGROUND

High-frequency heating devices, such as microwave ovens, microwave laundry dryers etc, are directly powered by the energy source via a transformer or by using an inverter circuit. Because the magnetron is powered by high-frequency switching currents, high-frequency heating devices that are powered by using an inverter circuit, operate at a lower efficiency.

The prior art document European Patent no. EP 0279514 describes a heating device comprising a magnetron powered by an inverter. By using the transistors added to the inverter circuit, it is achieved that the anode and inverter circuits of the magnetron, and a heater that is activated as the filament is turned on, are powered by a single power source.

Another prior art document, European Patent no. EP 0493604, describes a heating device comprising a magnetron powered by an inverter. By directing the inverter circuit through a control unit, it is achieved that the frequency of the resonance circuit coincides with the frequency of the control circuit at the time of starting and that the magnetron is turned on faster.

SUMMARY

The object of the present invention is the realization of a high-frequency heating device driven by an inverter, wherein the operating efficiency is increased by reducing the power loss that occurs in the inverter.

DESCRIPTION OF THE DRAWINGS

The high-frequency heating device designed to fulfill the objective of the present invention is illustrated on the annexed drawings, where.

DETAILED DESCRIPTION

Figure 1:
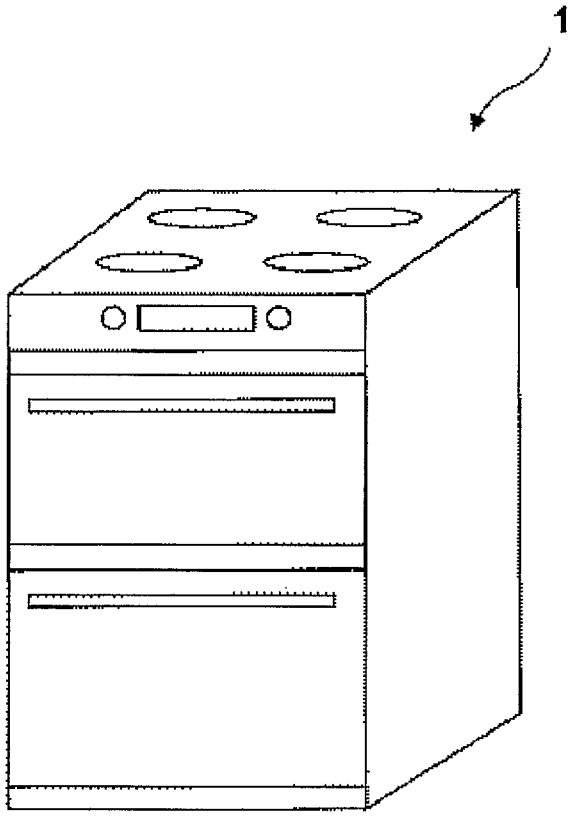
FIG. 1—is a schematic representation of a high-frequency heating device.
Figure 2:
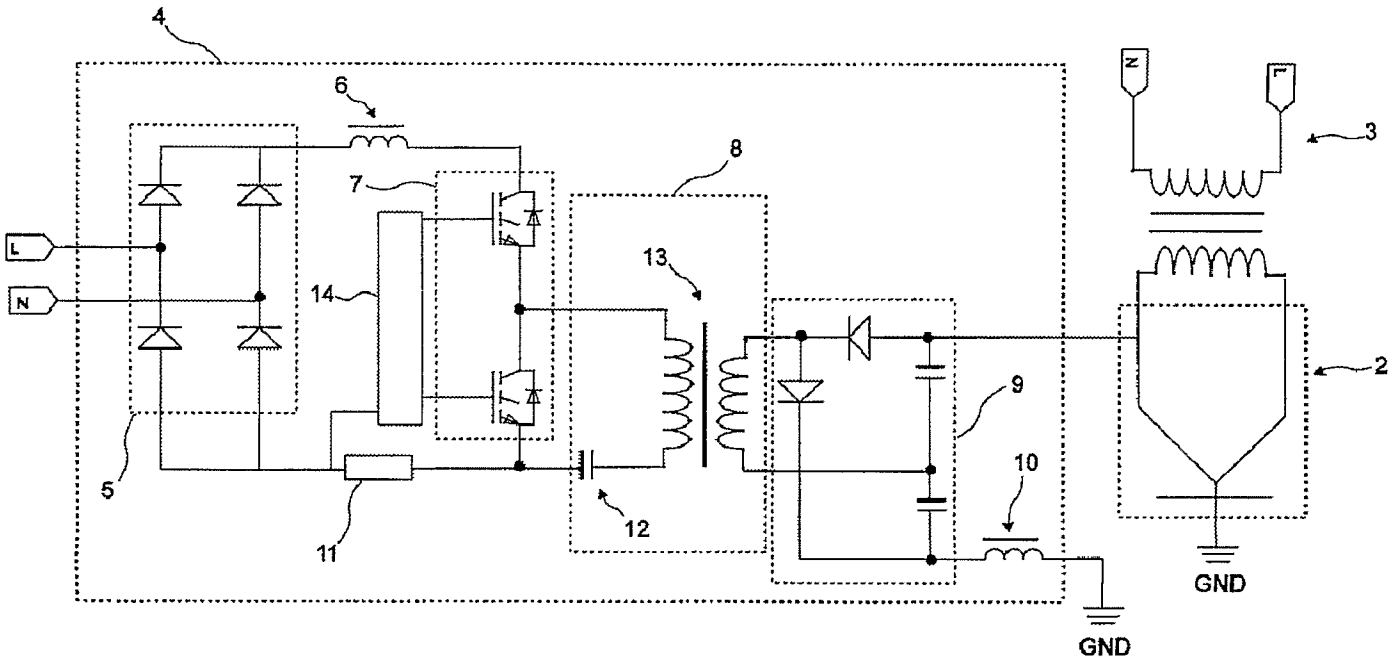
FIG. 2—is a schematic representation of an inverter and of a magnetron.

Parts shown on figures are numbered as follows:

1. High-frequency heating device
2. Magnetron
3. Filament circuit
4. Inverter
5. Diode bridge
6. High frequency filter
7. Power switching circuit
8. Resonant circuit
9. Wave multiplexer
10. Low pass filter
11. Current sensing resistor
12. Resonant capacitor
13. Resonant transformer
14. Control unit The high-frequency heating device (1), the subject of the present invention, comprises a magnetron (2) generating microwave energy, a filament circuit (3) that is powered preferably through the network by a high frequency power supply or by a conventional transformer and, an inverter (4) enabling the magnetron (2) to be powered by high-frequency rectified voltage via the energy obtained from the network.

The inverter (4) comprises a diode bridge (5) providing that the alternative current obtained from the network is converted to direct current, a high frequency filter (6) eliminating high-frequency noise from the voltage signal coming from the diode bridge (5), a power switching circuit (7) wherein the direct voltage coming from the high frequency filter (6) is converted to square-wave voltage, a current sensing resistor (11) which protects the switches in case of an excessive current and is used for power control, a resonant circuit (8) operated at a frequency above the resonant of the square-wave voltage coming from the power switching circuit (7), a wave multiplexer (9) whereby the voltage obtained from the high-frequency current coming from the resonant circuit (8) is multiplied by being raised and rectified, a low-pass filter (10) placed between the wave multiplexer (9) and the ground, providing that low-frequency noise is eliminated from the current without decreasing the voltage and that the current applied to the magnetron (2) is smoothed and, a control unit (14) which compares the current feedback obtained from the current sensing resistor (11) with the analog power reference and which switches the power switching circuit (7) according to the result of the comparison so as to feed the magnetron (2) at a constant power.

The resonant circuit (8) comprises a resonant transformer (13) and a resonant capacitor (12) which converts the square-wave voltage to a voltage similar to the sinusoidal voltage by transferring energy, if the frequency of the square-wave voltage is above the resonant value.

As the high-frequency heating device (1), subject to the present invention, is turned on, the filament circuit (3) is heated by the current and electrons start to be emitted from the tips of the filament circuit (3). At the same time, the emitted electrons are directed by the voltage applied to the magnetron (2) the voltage being of 4.5 kV with respect to ground and, it is achieved that the electrons are spread by vibrating them at a high frequency. The voltage that is obtained from the network in order to apply the desired high-frequency current to the magnetron (2) is processed by the inverter (4). By the diode bridge (5), the alternative current obtained from the network is converted to direct current. The voltage signal coming from the diode bridge (5) is passed through the high frequency filter (6) to eliminate high-frequency noise. The direct voltage coming from the high frequency filter (6) is converted to square-wave voltage via the power switching circuit (7). With the help of the resonant circuit (8) the structure of the output of the power switching circuit (7) is made similar to a sinusoidal wave. The high-frequency voltage coming from the resonant circuit (8) is rectified and doubled by the wave multiplexer (9). The current is applied to the magnetron (2) after being cleared off the low-frequency noise and smoothed by the low-pass filter (10) placed between the ground and the wave multiplexer (9).

In the inverter (4), the operating efficiency of the high-frequency heating device (1) is increased by changing the frequency of the current that is powering the magnetron (2), from a square-wave form to a sinusoidal form through placing a low-pass filter (10) between the ground and the wave multiplexer (9).

The invention claimed is:

1. The high-frequency heating device comprising:
a magnetron generating microwave energy,
a filament circuit and an inverter comprising a wave multiplexer coupled to a resonant circuit which ensures that the magnetron is powered by high-frequency rectified voltage obtained from a network coupled to the resonant circuit and, wherein voltage obtained from the high-frequency current coming from the resonant circuit is multiplied by being raised and rectified and wherein the inverter which includes a low-pass filter placed between the wave multiplexer and the ground, providing that low-frequency noise is eliminated from the current without decreasing the voltage and that the current applied to the magnetron is smoothed, wherein the current applied to magnetron has a sinusoidal form.

2. The high-frequency heating device comprising:

a magnetron generating microwave energy, a filament circuit and an inverter comprising a wave multiplexer coupled to a resonant circuit which ensures that the magnetron is powered by high-frequency rectified voltage obtained from a network coupled to the resonant circuit and, wherein voltage obtained from the high-frequency current coming from the resonant circuit is multiplied by being raised and rectified and wherein the inverter which includes a low-pass filter placed between the wave multiplexer and the ground, providing that low-frequency noise is eliminated from the current without decreasing the voltage and that the current applied to the magnetron is smoothed, wherein the current applied to magnetron has been changed from a square-wave form to a sinusoidal form.

* * * * *